US011008867B2

(12) United States Patent
Jang et al.

(10) Patent No.: US 11,008,867 B2
(45) Date of Patent: May 18, 2021

(54) SCROLL COMPRESSOR WITH WEAR-RESISTANT MEMBERS

(71) Applicant: LG ELECTRONICS INC., Seoul (KR)

(72) Inventors: Kitae Jang, Seoul (KR); Sanghun Seong, Seoul (KR); Jinyong Jang, Seoul (KR); Jongtae Her, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 110 days.

(21) Appl. No.: 16/225,058

(22) Filed: Dec. 19, 2018

(65) Prior Publication Data

US 2019/0211679 A1 Jul. 11, 2019

(30) Foreign Application Priority Data

Jan. 10, 2018 (KR) ..... 10-2018-0003503

(51) Int. Cl.
*F01C 17/06* (2006.01)
*F04C 29/00* (2006.01)
*F04C 18/02* (2006.01)

(52) U.S. Cl.
CPC ..... *F01C 17/066* (2013.01); *F04C 18/0215* (2013.01); *F04C 29/0057* (2013.01); *F04C 2240/801* (2013.01)

(58) Field of Classification Search
CPC ..... F01C 17/066; F04C 18/0215; F04C 2240/801; F04C 29/0057
See application file for complete search history.

(56) References Cited

U.S. PATENT DOCUMENTS 6,261,072 B1 7/2001 Abe et al.
2006/0159579 A1* 7/2006 Skinner ..... F04C 23/008 418/55.1

FOREIGN PATENT DOCUMENTS

EP 3199753 A1 * 8/2017 ..... F04C 18/0215
EP 3208417 8/2017
JP 1991267501 11/1991
JP H05231348 A 9/1993
KR 10-1718045 B1 3/2017

OTHER PUBLICATIONS

European Search Report dated Mar. 6, 2019.
Office Action of European Application No. 19150182.4 dated Feb. 14, 2020.

* cited by examiner

*Primary Examiner* — Mary Davis
(74) *Attorney, Agent, or Firm* — Finnegan, Henderson, Farabow, Garrett & Dunner, LLP

(57) ABSTRACT

A scroll compressor may include a casing configured to receive a rotation shaft and a driving unit; a compression unit provided with a frame configured to rotatably support the rotation shaft, a first scroll fixed to the casing, and a second scroll configured to be connected to the rotation shaft and engaged with the first scroll. An oldham ring is provided with a plurality of key portions to guide the second scroll to perform an orbiting movement, wherein at least one of the frame, the first scroll, and the second scroll includes a respective key groove formed to receive a respective key portion; and a respective wear-resistant member mounted to cover an inner surface of the respective key groove in contact with the respective key portion.

17 Claims, 4 Drawing Sheets

SCROLL COMPRESSOR WITH WEAR-RESISTANT MEMBERS

CROSS-REFERENCE TO RELATED APPLICATIONS

This application claims the benefit of priority under 35 U.S.C. § 119 to Korean Application No. 10-2018-0003503, filed on Jan. 10, 2018, whose entire disclosure is herein incorporated by reference.

FIELD

The present disclosure relates to a compressor, and more particularly, to a scroll compressor that compresses fluid while an orbiting scroll is rotated with respect to a fixed scroll.

BACKGROUND

In general, compressors for performing the role of compressing refrigerant in automotive air-conditioning systems have been developed in various forms, and in recent years, the development of electromotive compressors electrically driven using a motor have been actively carried out according to the trend of using electrical auto parts.

A scroll compression method suitable for a high compression ratio operation is mainly applied to electromotive compressors. Such a scroll compressor is provided with a motor unit composed of a rotary motor inside an enclosed casing, and a compression unit composed of a fixed scroll and an orbiting scroll is provided on one side of the motor unit. Furthermore, the motor unit and the compression unit are connected to each other by a rotation shaft to transmit a rotational force of the motor unit to the compression unit. A rotational force transmitted to the compression unit causes the orbiting scroll to perform an orbiting movement with respect to the fixed scroll to form a pair of two compression chambers comprising a suction chamber and an intermediate pressure chamber, and a discharge chamber so that refrigerant is sucked into both the compression chambers, respectively, and compressed and discharged simultaneously.

In the scroll compressor, an orbiting movement of the orbiting scroll with respect to the fixed scroll is implemented by the rotation shaft eccentrically coupled to an orbiting scroll to transmit a rotational force, and an oldham ring guiding an orbiting movement while preventing the rotation of the orbiting scroll.

Typically, the oldham ring is mounted such that a key portion protruded to one side is inserted into a key groove of the orbiting scroll, and a key portion protruded to the other side is inserted into a key groove of the fixed scroll (or frame). Furthermore, when an eccentric rotational force is transmitted to the orbiting scroll by the rotation shaft, the key portion is operated to slide in the key groove to prevent the rotation of the orbiting scroll.

In other words, since the key portion and the key groove are operated while being slid in contact with each other, the wear of the contact surfaces during the continuous operation of the scroll compressor may be a problem. In particular, a scroll, a frame or an oldham ring may be typically made of aluminum or the like in order to lighten the weight, but the contact surfaces of the same material are susceptible to friction, which may lower reliability.

As a result, there has been prior art for improving abrasion resistance through material selection and surface treatment of the oldham ring. However, the selection of high-strength materials and additional surface treatment could result in increased weight and increased manufacturing cost, and the like of the oldham ring.

Here, Patent Document 1 of the prior art discloses a structure in which a surface having a high abrasion resistance is treated with a coating or the like, and moreover, the material of the key portion is made of a material having a higher strength than that of the ring portion. However, it may cause problems such as increased cost of adding a surface coating process or adopting different materials, securing of strength at the time of coupling between the key portion and the ring portion of different materials, and the like.

Accordingly, it is desired to derive a design capable of alleviating wear between the oldham ring and the scroll structure without increasing the manufacturing cost of the oldham ring itself, and in particular, it is preferable to derive a structure that can be easily mounted on a friction surface while using an oldham ring in the related art as it is.

(Patent Document 1) KR 10-1718045 (Registered on Mar. 14, 2017)

SUMMARY

An object of the present disclosure is to provide a scroll compressor having a wear-resistant member that is brought into relatively close contact with a key groove to mitigate wear between the key portion and the key groove.

Another object of the present disclosure is to provide a scroll compressor having a wear-resistant member formed such that an assembly process of bringing the wear-resistant member into close contact with and fixed to a key groove is easily performed, thereby minimizing an increase in manufacturing cost.

In order to accomplish an object of the present disclosure, a scroll compressor according to the present disclosure may include a casing configured to receive a rotation shaft and a driving unit; a compression unit provided with a frame configured to rotatably support the rotation shaft, a first scroll fixed to the casing, and a second scroll configured to be connected to the rotation shaft and engaged with the first scroll; and an oldham ring provided with a plurality of key portions to guide the second scroll to perform an orbiting movement, wherein at least one of the frame, the first scroll, or the second scroll includes a key groove formed to receive the key portion; and a wear-resistant member is mounted to cover an inner surface of the key groove in contact with the key portion.

In order to accomplish another object of the present disclosure, in a scroll compressor according to the present disclosure, the key groove may be formed in a shape open to the outer circumferential side such that the second scroll and the frame are respectively recessed on surfaces facing each other, and the wear-resistant member may be extended in a U-shape to cover an inner side surface of the key groove, and provided with a head portion extended with a preset radius of curvature, and a pair of leg portions respectively connected to both ends of the head portion, and spaced apart from each other by a distance less than twice of a preset radius of curvature of the head portion and extended in parallel.

According to the present disclosure configured by the solution means described above, the following effects may be obtained.

The scroll compressor of the present disclosure may include a key portion mounted on an inner side surface of a key groove, thereby minimizing the wear of a frictional surface on which the key portion and the key groove slide relative to each other. In particular, there is an advantage that fabrication and assembly costs may be reduced compared with a case where an oldham ring is subjected to surface treatment separately or formed by coupling of different materials. In other words, a large number of wear-resistant members may be fabricated and used in bulk through a separate process, and it is advantageous in terms of cost reduction and productivity improvement because the oldham ring can be fabricated and assembled using a conventional process as it is.

The wear-resistant member of the scroll compressor of the present disclosure has a head portion and a leg portion which can be fixed while being inserted so as to be in close contact with the key groove, thereby easily assembling the wear-resistant member. The wear-resistant member may be fixed to the key groove without any additional coupling structure, thereby minimizing the assembly process from being complicated with the addition of the wear-resistant member.

BRIEF DESCRIPTION OF THE DRAWINGS

The embodiments will be described in detail with reference to the following drawings in which like reference numerals refer to like elements wherein.

DETAILED DESCRIPTION

Figure 1:
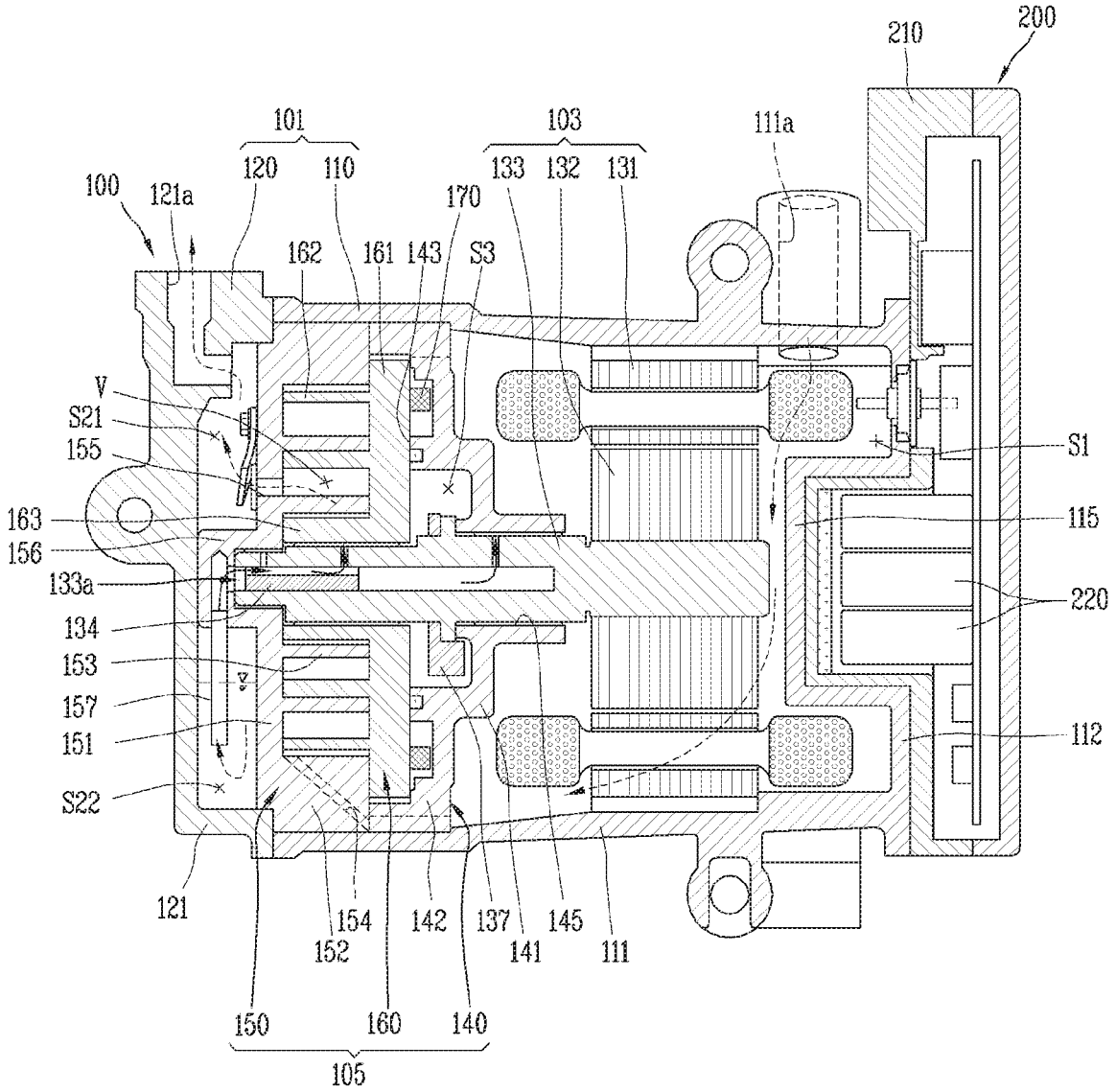
FIG. 1 is a cross-sectional view showing a scroll compressor according to an embodiment of the present disclosure.

Hereinafter, an electromotive compressor associated with the present disclosure will be described in detail with reference to the accompanying drawings.

Even in different embodiments, the same or similar components are designated with the same numeral references regardless of the numerals in the drawings and redundant description thereof will be omitted.

In describing the embodiments disclosed herein, moreover, the detailed description will be omitted when a specific description for publicly known technologies to which the invention pertains is judged to obscure the gist of the present disclosure.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

A singular representation may include a plural representation as far as it represents a definitely different meaning from the context.

A scroll compressor according to the present disclosure may be a component of a cooling cycle device that sucks and compresses R-134a as working fluid. In the present embodiment, FIG. 1 is a cross-sectional view showing a scroll compressor 100 according to an embodiment of the present disclosure.

Referring to FIG. 1, the scroll compressor 100 according to an embodiment of the present disclosure includes a casing 101, a driving unit 103, and a compression unit 105. The driving unit 103 and the compression unit 105 may be located inside a substantially cylindrical casing 101, and arranged to be connected to each other by a rotation shaft 133 which will be described later.

In addition, an inverter module 200 for controlling the operation speed of the compressor may be coupled to an outer end portion (front end portion) of the casing 101. The inverter module 200 may include an inverter housing 210 formed to have a preset volume and at least one or more inverters 220 accommodated inside the inverter housing 210.

As shown in FIG. 1, the casing 101 may include a main housing 110 and a rear cover 120. The main housing 110 is formed in a cylindrical shape having a rear opening, and a suction space (S1) may be formed in the main housing. The main housing 110 may include a cylindrical portion 111 and a sealing portion 112 that closes the front portion thereof, and further include an inverter receiving portion 115 recessed inwardly from the sealing portion 112 to accommodate the inverter module 200.

The suction space (S1) may communicate with an intake port 111*a* formed to pass through a side surface of the main housing 110. In the present embodiment, the intake port 111*a* is located adjacent to a side at which the inverter module 200 is mounted, and a flow path may be formed to dissipate the heat of the inverter module 200 by low-temperature suction refrigerant flowing into the intake port 111*a*.

The rear cover 120 may have a main body 121 formed to cover the other opening end portion (rear end portion) of the main housing 110. The rear cover 120 may be coupled to the main housing 110 while being brought into close contact with the first scroll 150 which will be described later to form a discharge space for accommodating high-pressure refrigerant compressed and discharged by the compression unit 105.

At this time, the discharge space may include an oil separation portion (S21) formed to separate oil from refrigerant being discharged and an oil storage portion (S22) for storing the separated oil. The oil separation portion (S21) may be located at an upper side of the discharge space, and the oil storage portion (S22) may be located at a lower side thereof. The oil storage portion (S22) may be configured to communicate with an oil supply passage structure for supplying oil to the rotation shaft 133 and the compression unit 105, which will be described later. An exhaust port 121*a* communicating with the oil separation portion (S21) to discharge refrigerant separated from the oil to the outside may be formed at an upper end portion of the rear cover 120.

The driving unit 103 is provided with a stator 131 and a rotor 132 to drive the rotation shaft 133. In the present embodiment, the stator 131 may be fixed to an inner circumferential surface of the main housing 110 to have an annular shape so as to form a cylindrical space inside the stator. The rotor 132 may be spaced apart from the stator 131 in the inner space of the stator 131. The rotor 132 may be formed in a substantially cylindrical shape, and the rotation shaft 133 may be coupled to the center of the rotor 132.

When power is supplied to the driving unit 103, the rotor 132 and the rotation shaft 133 may be rotated together by an interaction between the stator 131 and the rotor 132.

In the present embodiment, the rotation shaft 133 may be configured such that its central portion is supported by a frame 140, which will be described later. Additionally, one end portion (front end portion) of the rotation shaft 133 may not be supported separately, and the other end portion (rear end portion) may be supported by the first scroll 150. A balance weight 137 configured to rotate while forming an eccentric mass center in a back-pressure space (S3) which will be described later may be mounted on the rotation shaft 133.

The compression unit 105 may include a frame 140, a first scroll 150 that is a fixed scroll, and a second scroll 160 that is an orbiting scroll. The second scroll 160 is eccentrically coupled to the rotation shaft 133 coupled to the rotor 132 of the driving unit 103 to form a pair of compression chambers (V) formed of a suction chamber and an intermediate pressure chamber, and a discharge chamber along with the first scroll 150 while performing an orbiting movement with respect to the first scroll 150.

The frame 140 has a disk-shaped frame end plate portion 141 and a frame sidewall portion 142 protruded rearward from an outer circumferential side of the frame end plate portion 141. A thrust surface 143 may be formed on an inner side of the frame sidewall portion 142 to support the second scroll 160 in an axial direction. In addition, part of refrigerant discharged from the compression chamber may be filled together with oil at the center of the thrust surface 143 to form a back-pressure space (S3) supporting a rear surface of the second scroll 160. A frame shaft hole 145 may be formed at the center of the back-pressure space (S3) to support the rotation shaft 133 therethrough.

The first scroll 150 may include a fixed-side end plate portion 151 formed in a disk shape and a fixed-side sidewall portion 152 protruded toward the frame 140 on one side of the fixed-side end plate portion 151. The fixed-side sidewall portion 152 may be coupled to and supported by the frame sidewall portion 142, and a fixed wrap 153 engaged with an orbiting wrap 162, which will be described later, to form a pair of two compression chambers (V) is protruded at a central portion of the fixed-side end plate portion 151.

Furthermore, a suction passage 154 communicating with the suction space (S1) of the casing 101 is formed at an edge of the fixed-side end plate portion 151, and a discharge port 155 communicating from a final compression chamber to the discharge space (S2) may be formed at the center of the fixed-side end plate portion 151.

The second scroll 160 is provided with an orbiting-side end plate portion 161 formed in a disk shape, and an orbiting wrap 162 protruded toward the fixed-side end plate portion 151 and engaged with the fixed wrap 153 is formed on a rear side of the orbiting-side end plate portion 161. The second scroll 160 may be coupled eccentrically with respect to the rotation shaft 133 to implement an orbiting movement by an oldham ring 170 which will be described later.

The scroll compressor 100 according to the present embodiment may configured with a shaft penetration structure. In other words, a rotation shaft coupling portion 163 which forms an inner end portion of the orbiting wrap 162 and to which the rotation shaft 133 is rotatably inserted and coupled may be formed in an axially penetrating manner at a central portion of the orbiting-side end plate portion 161. An outer circumferential portion of the rotation shaft coupling portion 163 is connected to the orbiting wrap 162 to form the compression chamber (V) together with the fixed wrap 153 during the compression process.

The rotation shaft coupling portion 163 may be formed to have a height that overlaps with the orbiting wrap 162 on the same plane, and disposed at a height where the rotation shaft 133 overlaps with the orbiting wrap 162 on the same plane. Through this, the repulsive force and the compressive force of the refrigerant cancel each other while being applied to the same plane with respect to the orbiting-side end plate portion 161, thereby preventing an inclination of the second scroll 160 due to an action of the compressive force and the repulsive force.

Furthermore, the rotation shaft 133 inserted into the rotation shaft coupling portion 163 may be axially supported on the first scroll 150 through the second scroll 160. The bearing receiving portion 156 may be protruded toward an inner wall side of the rear cover 120 on a rear side of the fixed side plate 151. The bearing receiving portion 156 may be brought into close contact with or spaced apart by a predetermined distance from the inner wall side of the rear cover 120.

In addition, an oil supply pipe 157 protruded toward a bottom side of the discharge space (S2) may be connected to the bearing receiving portion 156. Accordingly, an inner space of the bearing receiving portion 156 is connected to the oil storage portion (S22) of the discharge space (S2), and thus oil filled in the oil storage portion (S22) may flow into the inner space of the bearing receiving portion 156 by a pressure difference. An oil passage 133*a* formed in a penetrating manner to communicate with an inner space of the bearing receiving portion 156 may be formed inside the rotation shaft 133 and a pressure-sensitive member 134 or the like may be mounted inside the oil passage 133*a* that receives oil from the oil storage unit (S22).

The foregoing scroll compressor 100 according to the present disclosure operates as follows.

First, when power is applied to the driving unit 103, the rotation shaft 133 transmits a rotational force to the second scroll 160 while rotating together with the rotor 132 of the driving unit 103. Then, the second scroll 160 connected eccentrically to the rotation shaft 133 performs an orbiting movement by an eccentric distance, and a volume of the compression chamber (V) decreases while being continuously moved toward the center side in a radial direction of the rotation shaft 133.

Accordingly, refrigerant flows into the suction space (S1) through the intake port 111*a*. Refrigerant flowing into the suction space (S1) may perform the cooling of the inverter module 200, the stator 131 and the rotor 132, and may be sucked into the compression chamber (V) through the suction passage 154.

The refrigerant sucked into the compression chamber (V) is compressed while being moved toward the center side along the movement path of the compression chamber (V), and discharged into the discharge space (S2) formed between the first scroll 150 and the rear cover 120 through the discharge port 155.

The refrigerant discharged into the discharge space (S2) is discharged to the cooling cycle device outside the compressor through the exhaust port 121*a* after oil component is separated in the oil separation portion (S21). The separated oil remains in the oil storage portion (S22), and then passes through the inner space of the bearing receiving portion 156 and the oil passage 133*a* to perform the lubrication and cooling of the bearing, and may flow into the compression chamber (V) or the back-pressure space (S3).

The overall structure and operation of the scroll compressor 100 according to the present disclosure have been described above. Hereinafter, the structure and function of the oldham ring 170 will be described in detail according to each embodiment of the present disclosure.

Figure 2:
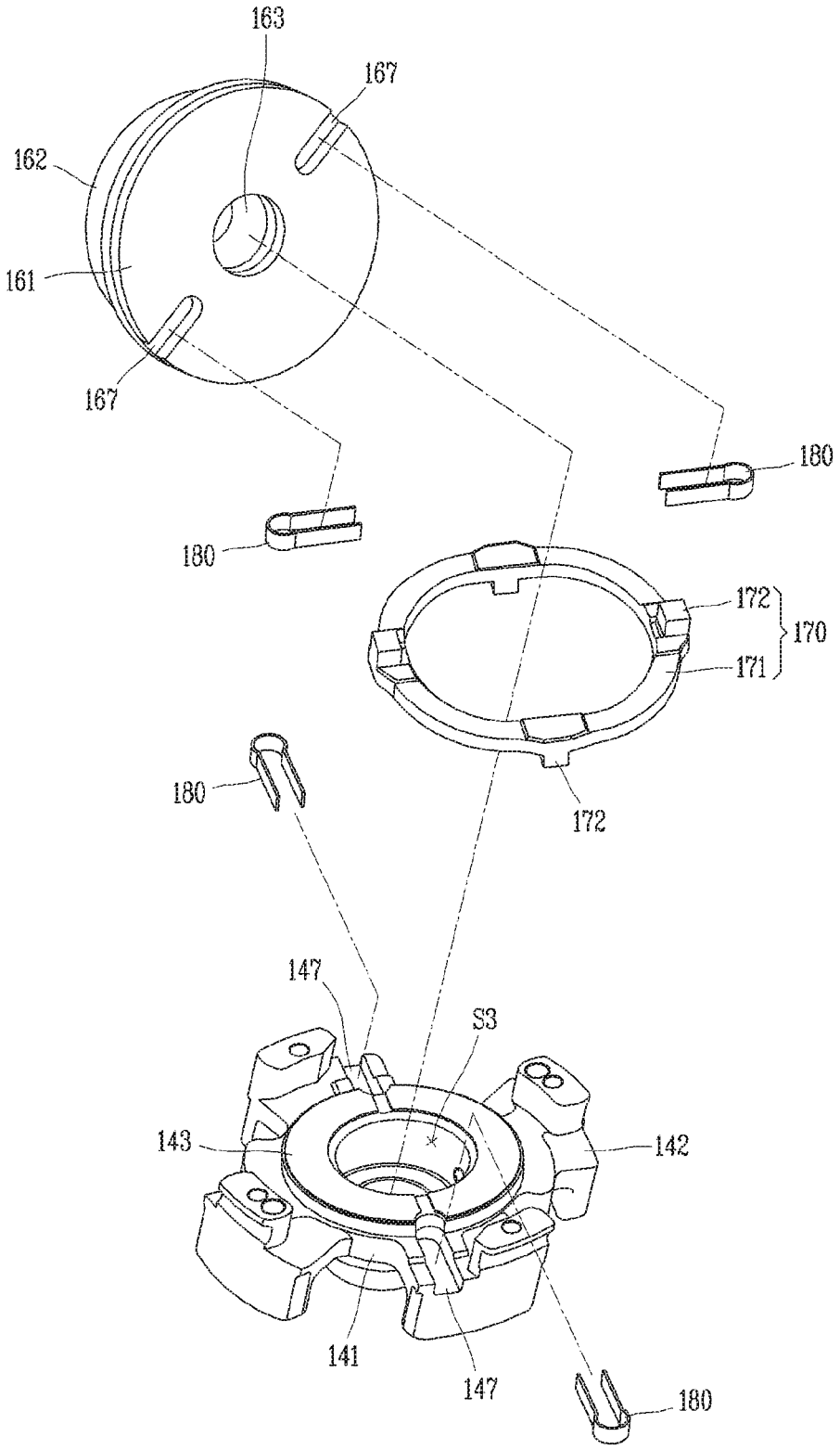
FIG. 2 is an exploded perspective view showing a frame, a second scroll, an oldham ring and a wear-resistant member illustrated in FIG. 1.
Figure 3:
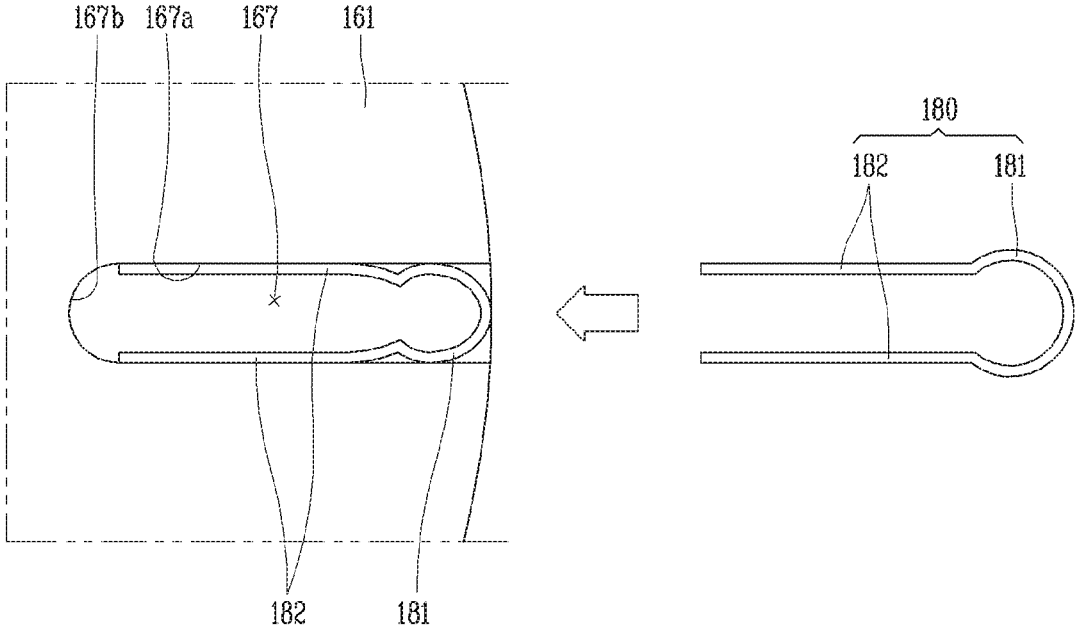
FIG. 3 is a conceptual view showing the wear-resistant member illustrated in FIG. 2 and a state in which the wear-resistant member is inserted into a key groove.

FIG. 2 is an exploded perspective view showing the frame 140, the second scroll 160, the oldham ring 170 and the wear-resistant member 180 shown in FIG. 1, and FIG. 3 is an conceptual view showing the wear-resistant member 180 and a state in which the wear-resistant member 180 is inserted into the key groove 147, 167.

The scroll compressor 100 according to the present disclosure may further include an oldham ring 170 to allow the second scroll 160 to implement an orbiting movement with respect to the first scroll 150 and the frame 140.

In this embodiment, the oldham ring 170 may be interposed between the frame 140 and the second scroll 160. As shown in FIG. 2, the oldham ring 170 may be slidably mounted between the orbiting-side end plate portion 161 and the frame 140, and may include a ring portion 171 mounted on the frame 140 to surround the back-pressure space (S3) and the thrust surface 143, and a plurality of key portions 172 protruded to the front and rear sides of the ring portion 171, respectively.

Moreover, the key portion 172 may be inserted into a plurality of key grooves 147, 167 formed to be recessed from a front side of the orbiting-side end plate portion 161 and a rear side of the frame 140, respectively. With the insertion structure of the key portion 172 and the key grooves 147, 167, a translational movement in a predetermined range is allowed but a rotational movement is prevented for the second scroll 160 with respect to the frame 140. Accordingly, when the second scroll 160 eccentrically coupled to the rotation shaft 133 receives a rotational force, the second scroll 160 performs an orbiting movement with respect to the frame 140 and the first scroll 150.

Here, the present embodiment illustrates an example in which the oldham ring 170 is interposed between the second scroll 160 and the frame 140, but may also be configured with a structure in which the oldham ring 170 is interposed between the first scroll 150 and the second scroll 160.

However, during the orbiting movement of the second scroll 160, the key portion 172 and the key grooves 147, 167 are continuously brought into contact with each other to generate a friction. Continuous friction generated when the compressor is operated for a long period of time causes wear of the ring portion 171, the key portion 172 and the key grooves 147, 167, thereby causing reliability problems in the compressor. In particular, when the oldham ring 170, the second scroll 160, and the frame 140 are made of the same aluminum material, sintering may occur on a friction surface. In addition, when the oldham ring 170 is made of an iron material to improve wear resistance, the weight of the oldham ring 170 may become heavy to reduce efficiency. There is a problem that fabrication cost and complexity increase even when only a frictional portion is surface-treated or made of different materials to minimize the weight increase of the oldham ring 170.

At least either one of the frame 140 and the first and second scrolls 150, 160 according to an embodiment of the present disclosure may include a wear-resistant member 180 formed to cover an inner surface of the key grooves 147, 167. The wear-resistant member 180 may be formed to cover an inner surface in contact with the key portion 172 on an inner side surface of the key grooves 147, 167, and the material thereof may be made of a different material from that of the key portion 172 and the key grooves 147, 167. For example, when the first scroll 150 and the frame 140 are made of aluminum, the wear-resistant member 180 may be made of iron.

The abrasion member 180 may be interposed between the key portion 172 and the key grooves 147, 167, thereby minimizing the wear of a frictional surface on which the key portion 172 and the key grooves 147, 167 slide with each other during the operation of the scroll compressor 100 of the present disclosure. In particular, there is an advantage that fabrication and assembly costs may be reduced compared with a case where the oldham ring 170 is subjected to surface treatment separately or formed by coupling of different materials. In other words, a large number of wear-resistant members 180 may be fabricated and used in bulk through a separate process, and it is advantageous in terms of cost reduction and productivity improvement because the oldham ring 170 can be fabricated and assembled using a conventional process as it is.

Specifically, the key grooves 147, 167 may be formed to be recessed on the orbiting-side and frame end plate portions 161, 141 in a shape open to an outer circumferential side, on a surface where the orbiting-side end plate portion 161 and the frame end plate portion face each other. As shown in the drawing, an inner space of the key grooves 147, 167 may be extended by a preset distance in a radial direction of the rotation shaft 133. A center side end portion opposite to an open outer circumferential surface side may be formed to have a shape in which the inner side surface is roundly connected.

Accordingly, the key grooves 147, 167 are formed with inner flat surface portions 167*a* extended parallel to a radial direction of the rotation shaft 133 while facing each other and inner curved surface portions 167*b* extended in a curved surface to connect the inner flat surface portions 167*a* to each other. As a whole, the inner flat surface portion 167*a* and the inner curved surface portion 167*b* may be connected in a U-shape.

In addition, the wear-resistant member 180 may be formed to extend in a U-shape so as to cover the inner side surfaces of the key grooves 147, 167. As shown in FIGS. 2 and 3, the wear-resistant member 180 may be inserted in a direction opposite to the U-shaped inner side surface formed in the key groove 147, 167, but according to circumstances, may be inserted in the same direction to cover all of the U-shaped inner side surfaces of the key grooves 147, 167. The width of the wear-resistant member 180 in an axial direction of the rotation shaft 133 may be formed equal to or smaller than that of the key grooves 147, 167 in a state where the wear-resistant member 180 is inserted into the key grooves 147, 167.

In other words, the wear-resistant member 180 may include a head portion 181 and a pair of leg portions 182. The head portion 181 may be configured to extend approximately 180 degrees with a preset radius of curvature. Furthermore, the pair of leg portions 182 may be connected and extended to both end portions of the head portion 181. The pair of leg portions 182 may be formed smaller than or equal to an axial length of the rotation axis 133 of the key grooves 147, 167.

The scroll compressor 100 according to the present disclosure may be configured to easily perform an additional process of assembling the wear-resistant member 180. To this end, the wear-resistant member 180 may be made of an elastic material, and may be inserted and fixed to the key grooves 147, 167 by elastic deformation.

In the present embodiment, the pair of leg portions 182 may be spaced apart from each other by a distance less than twice of a preset radius of curvature of the head portion 181. In other words, as shown in the drawing, the head portion 181 may be formed to protrude more than a spaced distance of the leg portions 182.

In addition, the inner curved surface portion 167*b* of the key grooves 147, 167 may be connected with a radius of curvature smaller than that of an outer surface of the head portion 181, and a distance between the inner flat surface portions 167*a* of the key grooves 147, 167 may be made to face each other with a width larger than that between the outer surfaces of the pair of leg portions 182. However, according to the rigidity of the wear-resistant member 180, a distance between the inner flat surface portions 167*a* of the key grooves 147, 167 and a distance between the outer surfaces of the pair of leg portions 182 may be formed equal to each other.

Accordingly, as shown in the drawing, as the wear-resistant member 180 is inserted from an open-end portion of the key groove 147, 167, the head portion 181 may be inserted and fixed as supported on the inner flat surface portion 167*a* while causing elastic deformation. Furthermore, the pair of leg portions 182 may be deformed to be distanced from each other due to the elastic deformation of the head portion 181, and thus mounted while being supported on the inner flat surface portion 167*a*.

Therefore, the wear-resistant member 180 of the scroll compressor 100 of the present disclosure may be stably fixed while being inserted in close contact with the key grooves 147, 167. As a result, the assembly and fixing of the wear-resistant member 180 may be easily carried out, and an additional coupling structure may be omitted, thereby minimizing the complication of the assembling process with the addition of the wear-resistant member 180.

However, since the wear-resistant member 180 can be press-fitted into the key grooves 147, 167, the wear-resistant member 180 may be formed larger than the key grooves 147, 167, and inserted and fixed through a press-fitting process.

Figure 4:
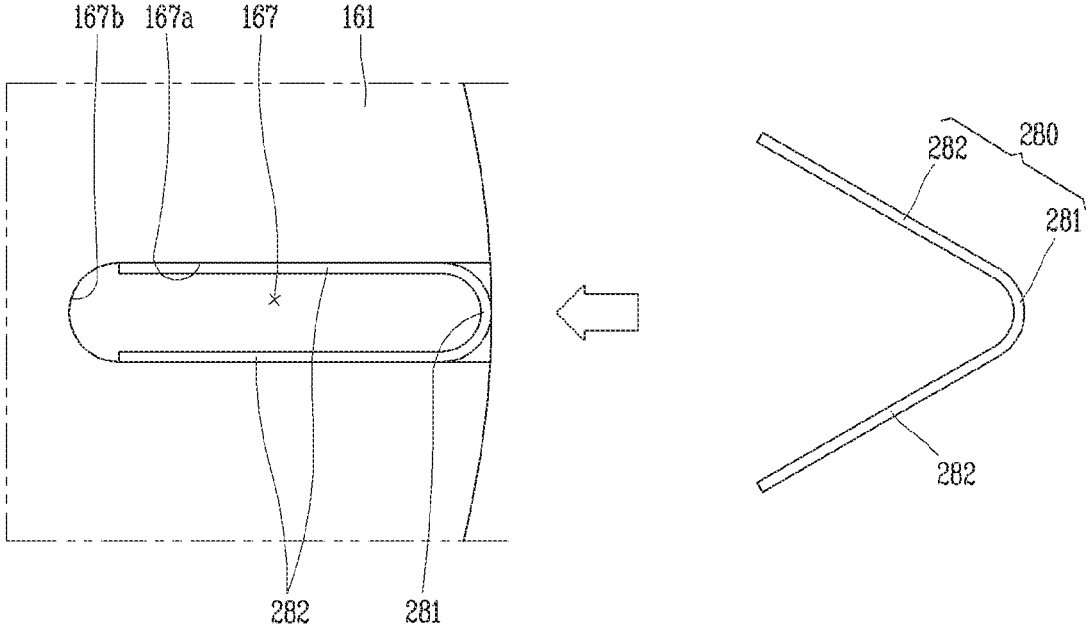
FIG. 4 is a conceptual view showing a wear-resistant member of the scroll compressor according to another embodiment and a state in which the wear-resistant member is inserted into a key groove.

FIG. 4 is a conceptual view showing the wear-resistant member 280 of the scroll compressor 100 according to another embodiment of the present disclosure and a state in which the wear-resistant member 280 is inserted into the key groove 167. Hereinafter, another embodiment of the wear-resistant member 280 having a shape different from that of the previous embodiment will be described.

Referring to FIG. 4, the wear-resistant member 280 may include a head portion 281 and a pair of leg portions 282 as in the previous embodiment. Furthermore, the head portion 281 may be formed to extend to a preset radius of curvature.

However, the pair of leg portions 282 of the present embodiment may be extended to increase a distance between both end portions of the head portion 281. At this time, a value twice as large as the radius of curvature of the outer circumferential surface of the head portion 281 may be formed equal to a distance between the inner flat surface portions 167*a* of the key groove 167.

In the present embodiment, a pair of leg portions 282 may be inserted into the key groove 167 in an elastically deformed state. The pair of leg portions 282 may be pressed and supported on the inner flat surface portion 167*a* by a restoring force in the key groove 167.

In addition, the wear-resistant member 280 of the present embodiment may be inserted from the head portion 281 into an open-end portion of the key groove 167 to facilitate assembly. Accordingly, the wear-resistant member 280 may be coupled to the inner curved surface portion 167*b* in such a shape that the inner curved surface portion 167*b* and an outer circumferential surface of the head portion 281 are in contact with and supported by each other.

Figure 5:
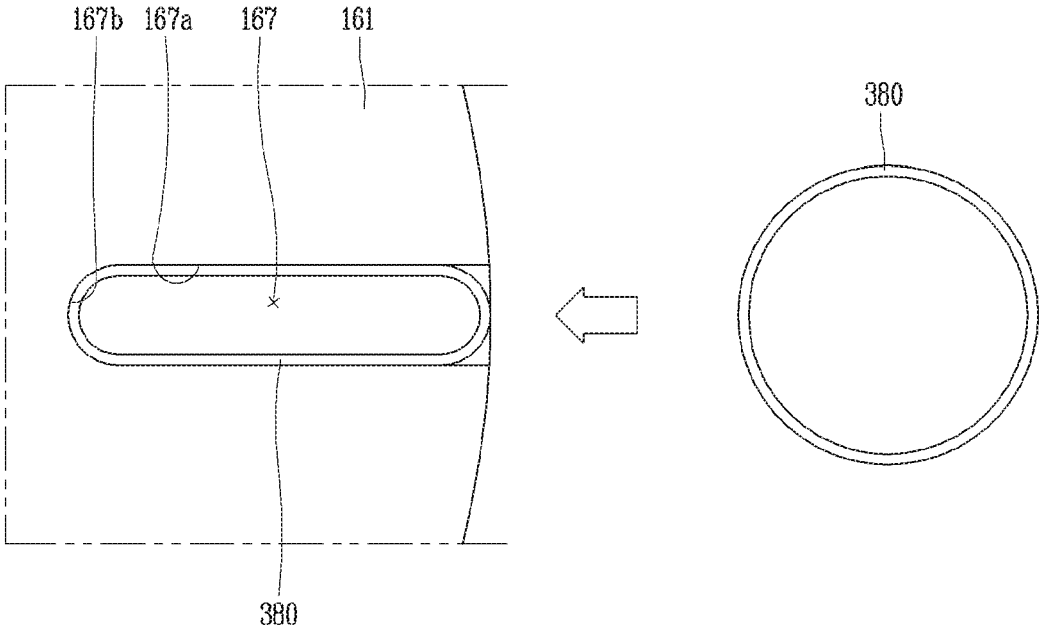
FIG. 5 is a conceptual view showing a wear-resistant member of the scroll compressor according to still another embodiment and a state in which the wear-resistant member is inserted into a key groove.

On the other hand, FIG. 5 is a conceptual view showing the wear-resistant member 380 of the scroll compressor 100 according to still another embodiment of the present disclosure and a state in which the wear-resistant member 380 is inserted into the key groove 167. The still another embodiment of the present disclosure also illustrates an example in which the wear-resistant member 380 is configured to be easily inserted into the key groove 167.

Referring to FIG. 5, the wear-resistant member 380 of this embodiment may be formed in an annular shape. The wear-resistant member 380 may be formed in a band-like shape with a width equal to or smaller than an axial depth of the inner flat surface portion 167*a* and the curved surface portion.

In addition, the wear-resistant member 380 of the present embodiment may be made of an elastic material, and inserted into an inner side surface of the key groove 167 in an elastically deformed state. The wear-resistant may be supported and fixed to the inner flat surface portion 167*a* and the curved surface portion of the key groove 167 by a restoring force due to elastic deformation.

At this time, a circumferential length of the annular wear-resistant member 380 may be formed less than or equal to a circumference of the key groove 167, and inserted without protruding toward the open-end portion within the key groove 167.

The foregoing description is merely embodiments for implementing an electromotive compressor according to the present disclosure, and the present disclosure may not be necessarily limited to the foregoing embodiments, and it will be understood by those skilled in the art that various modifications can be made without departing from the gist of the invention as defined in the following claims.

What is claimed is:

1. A scroll compressor, comprising:

a casing;

a rotation shaft located inside the casing;

a driving unit configured to rotate the rotation shaft;

a compression unit provided with a frame fixed to the casing to rotatably support the rotation shaft, a first scroll located to be fixed to the casing, and a second scroll configured to be connected to the rotation shaft and engaged with the first scroll; and an oldham ring provided with a plurality of key portions to guide the second scroll to perform an orbiting movement, wherein at least one of the frame, the first scroll, and the second scroll comprises:

a respective key groove formed to receive a respective key portion of the plurality of key portions; and a respective wear-resistant member mounted to cover an inner surface of the respective key groove, the respective wear-resistant member being in contact with the respective key portion, wherein the respective wear-resistant member is formed in an annular shape and made of an elastic material that deforms when the respective wear-resistant member is inserted into the respective key groove to be supported by opposite inner side surfaces of the respective key groove.

2. The scroll compressor of claim 1, wherein each respective wear-resistant member is formed of a material different from that of the respective key groove and the respective key portion.

3. The scroll compressor of claim 1, wherein a respective key groove is formed in each of the frame and the second scroll in a shape open to an outer circumferential side of the frame and the second scroll, respectively, such that the second scroll and the frame are respectively recessed on surfaces facing each other, and the respective wear-resistant member is extended in a U-shape to cover an inner side surface of the respective key groove.

4. The scroll compressor of claim 3, wherein the respective wear-resistant member comprises:

a head portion extended with a preset radius of curvature; and a pair of leg portions respectively connected to both ends of the head portion, and spaced apart from each other by a distance less than twice of a preset radius of curvature of the head portion and extended in parallel to each other.

5. The scroll compressor of claim 4, wherein the respective key groove comprises:

an inner curved surface portion formed with a curved surface having a radius of curvature smaller than that of an outer surface of the head portion; and inner flat surface portions formed to face each other with a width larger than a distance between the outer surfaces of the leg portions parallel to each other.

6. The scroll compressor of claim 3, wherein the respective wear-resistant member comprises:

a head portion extended with a preset radius of curvature; and a pair of leg portions extended respectively from opposite end portions of the head portion to diverge to increasing distances from each other at greater distances from the head portion and inserted to be supported on opposite inner side surfaces of the respective key groove by elastic deformation.

7. The scroll compressor of claim 1, wherein a circumferential length of the respective wear-resistant member is formed smaller than a circumferential length of the respective key groove.

8. The scroll compressor of claim 1, wherein the oldham ring comprises a ring portion mounted on the frame and the plurality of key portions protrude from opposite front and rear sides of the ring portion to be received in respective key grooves recessed from a front side of an orbiting side end plate portion of the second scroll and a rear side of the frame.

9. A scroll compressor, comprising:

a casing;

a rotation shaft located inside the casing;

a driving unit configured to rotate the rotation shaft;

a compression unit provided with a frame fixed to the casing to rotatably support the rotation shaft, a first scroll fixed to the casing, and a second scroll configured to be connected to the rotation shaft and engaged with the first scroll; and an oldham ring provided with a ring portion and a plurality of key portions protruding from opposite front and rear sides of the ring portion to guide the second scroll to perform an orbiting movement, wherein the second scroll comprises:

a respective key groove formed to receive a respective key portion of the plurality of key portions; and a respective wear-resistant member mounted to cover an inner surface of the respective key groove in contact with the respective key portion, wherein the respective wear-resistant member is formed in an annular shape and made of an elastic material that deforms when the respective wear-resistant member is inserted into the respective key groove to be supported by opposite inner side surfaces of the respective key groove.

10. The scroll compressor of claim 9, wherein each respective wear-resistant member is formed of a material different from that of the respective key groove and the respective key portion.

11. The scroll compressor of claim 9, wherein a respective key groove is formed in the second scroll in a shape open to an outer circumferential side of the second scroll, and the respective wear-resistant member is extended in a U-shape to cover an inner side surface of the respective key groove.

12. The scroll compressor of claim 11, wherein the respective wear-resistant member comprises:

a head portion extended with a preset radius of curvature; and a pair of leg portions respectively connected to both ends of the head portion and spaced apart from each other by a distance less than twice of a preset radius of curvature of the head portion and extended in parallel to each other.

13. The scroll compressor of claim 12, wherein the respective key groove comprises:

an inner curved surface portion formed with a curved surface having a radius of curvature smaller than that of an outer surface of the head portion; and inner flat surface portions formed to face each other with a width larger than a distance between the outer surfaces of the leg portions parallel to each other.

14. The scroll compressor of claim 13, wherein the respective wear-resistant member is inserted into the respective key groove with the pair of leg portions of the respective wear-resistant member inserted first toward the inner curved surface portion of the respective key groove.

15. The scroll compressor of claim 13, wherein the respective wear-resistant member is inserted into the respective key groove with the head portion of the respective wear-resistant member inserted first toward the inner curved surface portion of the respective key groove.

16. The scroll compressor of claim 11, wherein the respective wear-resistant member comprises:

a head portion extended with a preset radius of curvature; and a pair of leg portions extended respectively from opposite end portions of the head portion to diverge to increasing distances from each other at greater distances from the head portion and inserted to be supported on opposite inner side surfaces of the respective key groove by elastic deformation.

17. The scroll compressor of claim 9, wherein a circumferential length of the respective wear-resistant member is formed smaller than a circumferential length of the respective key groove.

* * * * *